US006705132B1

(12) United States Patent
Hajek

(10) Patent No.: US 6,705,132 B1
(45) Date of Patent: Mar. 16, 2004

(54) LOOP-TYPE TEXTILE FASTENER FABRIC WITH DIAGONALLY EXTENDING PILE LOOPS AND METHOD OF PRODUCING SAME

(75) Inventor: Peter Hajek, Burlington, NC (US)

(73) Assignee: GFD Fabrics, Inc., Greensboro, NC (US)

( * ) Notice: Subject to any disclaimer, the term of this patent is extended or adjusted under 35 U.S.C. 154(b) by 0 days.

(21) Appl. No.: 10/426,283

(22) Filed: Apr. 30, 2003

(51) Int. Cl.[7] ..... D04B 21/04
(52) U.S. Cl. ..... 66/194
(58) Field of Search ..... 66/191, 192, 195, 66/194, 193, 190; 24/445, 446, 449

(56) References Cited

U.S. PATENT DOCUMENTS

| | | | | |
|---|---|---|---|---|
| 4,709,562 A | | 12/1987 | Matsuda | 66/193 |
| 5,125,246 A | | 6/1992 | Shytles | 66/193 |
| 5,214,942 A | | 6/1993 | Peake, III et al. | 66/194 |
| 5,267,453 A | | 12/1993 | Peake, III et al. | 66/194 |
| 5,407,722 A | | 4/1995 | Peake, III et al. | 428/88 |
| 5,449,530 A | | 9/1995 | Peake, III et al. | 427/244 |
| 5,520,021 A | | 5/1996 | Clerici | 66/193 |
| 5,664,441 A | | 9/1997 | Clerici | 66/193 |
| 5,736,214 A | | 4/1998 | Billarant | 428/92 |
| 5,916,273 A | * | 6/1999 | Hepfinger | 66/194 |
| 6,216,496 B1 | * | 4/2001 | Gehring | 66/191 |

* cited by examiner

*Primary Examiner*—Danny Worrell
(74) *Attorney, Agent, or Firm*—Kennedy Covington Lobdell & Hickman, LLP

(57) ABSTRACT

A warp knitted textile fabric suitable for use as the loop component of a hook-and-loop fastener is formed of two sets of ground yarns knitted in a dimensionally stable construction with a set of pile loop-forming yarns formed in a stitch pattern producing elongated underlap loops outwardly extending diagonally in a back-and-forth zig-zag like pattern at the technical back of the fabric to be readily interengaged with the hook elements of a mating hook. A method of producing the fabric is also disclosed.

12 Claims, 1 Drawing Sheet

LOOP-TYPE TEXTILE FASTENER FABRIC WITH DIAGONALLY EXTENDING PILE LOOPS AND METHOD OF PRODUCING SAME

BACKGROUND OF THE INVENTION

The present invention relates generally to fabric fasteners of the type commonly referred to as hook-and-loop fasteners. More particularly, the present invention relates to a novel warp-knitted loop-type textile fastener fabric having pile loops that extend diagonally relative to the fabric extent and a method of producing such a fastener fabric on a warp knitting machine.

So-called hook-and-loop fasteners have gained considerable popularity over recent years. Such fasteners basically include two generally flat components attachable and detachable to and from face abutting relation with one another. Typically, the loop or "female" fastener component is of a textile fabric construction, generally having a fabric ground layer with a plurality of relatively flexible pile-type loops extending outwardly from one face of the ground layer. The hook or "male" component may be of an extruded or molded plastic construction having any of various forms of relatively stiff, molded or extruded hook-shaped elements extending in upstanding relation from one face of a ground layer, or may also be of a textile fabric construction similarly having a fabric ground layer with a plurality of hook-shaped elements upstanding from one face of the ground layer. In use, the hook and loop faces of the fastener components grippingly engage one another when pressed together in face abutting relation by penetration of the hook-shaped elements of the hook component into the loops at the opposing face of the loop component. The engagement between the hook and loop faces of the two components resists separation thereof until a threshold force is exerted on one component in a peeling-like fashion.

Over recent years, it has been suggested and has become commonplace to produce the loop component fabric in a warp-knitted construction which can be made in various widths and can be engineered to be susceptible of many diverse end-use applications. The typical knitting methodology by which such fabrics are made involves knitting a ground fabric structure utilizing only selected needles of the needle bar of the warp knitting machine, e.g., usually alternate needles, while simultaneously knitting pile or other loop-forming yarns integrally with the ground fabric structure in alternate courses and holding the pile yarns on inactive needles, e.g., the intervening needles, in knitting the intervening courses. The extent of the pile yarns held on the inactive needles is cast off such needles in the knitting of the succeeding course and thereby is not knitted into the ground structure but rather extends outwardly therefrom as an extended underlap at the technical back of the fabric to form pile loops thereat. While many differing specific stitch constructions are possible within this general fabric forming criterion, all of the known loop-type fabrics of this warp knitted construction provide for knitting of each pile yarn in a single common wale, whereby the pile loops align warpwise within their respective wales. Such walewise alignment of the pile loops, however, has been found in actual use to provide a less than optimal ability of the loops to engage with hook-shaped elements of a mating hook component. Therefore, it would be desirable to improve the "peel strength" of such fabrics, i.e., the threshold force required to separate the loop and hook components from engagement with one another.

SUMMARY OF THE INVENTION

In view of the above described disadvantages of known warp knitted loop component fabrics for use in a hook-and-loop fastener, the present invention contemplates the warp knitting of such a fabric in a novel knitted structure which provides diagonally oriented pile loops, most preferably extending in alternatingly opposite diagonal directions, to optimize the availability of the loops for engagement with a mating hook component fabric and to contribute to the structural integrity of the overall fabric. An additional object of the present invention is to provide a novel warp knitting method for fabricating the loop fastener component of the present invention.

Briefly summarized, the present invention provides a warp knitted textile fabric having underlap loops at one face adapted for mated engagement with hooking elements of a hook component in a the hook-and-loop type fastener. Specifically, the fabric of the present invention comprises yarns formed in needle loops arranged in longitudinally extending wales and transversely extending courses including at least one set of ground yarns and a set of pile yarns warp knitted in respective cooperating stitch patterns wherein the pile yarns and ground yarns are interknitted in needle loops in spaced wales and spaced courses with underlap loops of the pile yarns formed at the technical back of the fabric extending diagonally between the spaced wales and spaced courses.

Preferably, at least two sets of ground yarns are utilized in the fabric, with a first set of ground yarns being formed in needle loops in spaced wales of every course and a second set of ground yarns formed in needle loops in a chain stitch pattern in the spaced wales. In a preferred embodiment, the first set of ground yarns are warp knitted in a 1-0, 4-5 stitch pattern, the second set of ground yarns are warp knitted in a 0-1, 1-0 chain stitch pattern, and the pile yarns are warp knitted in a 1-2, 0-1, 4-3, 5-4 stitch pattern. Thus, the underlap loops of the pile yarns extend outwardly from the technical back of the fabric in opposite directions coursewise of the fabric.

The present invention also contemplates a method of producing a warp knitted textile fabric suitable for use as the loop component of a hook-and-loop type fastener. Basically, the present method includes the steps of simultaneously warp knitting at least one set of ground yarns and a set of pile yarns in cooperating stitch patterns of needle loops on the needle bar to form a warp knitted fabric. More specifically, the present invention provides for the warp knitting of each pile yarn by sequentially interknitting a first needle loop of the pile yarn with a needle loop of a ground yarn on a selected needle of the needle bar, interveningly holding an extent of the pile yarn in a non-knitting manner on a second needle of the needle bar unoccupied by any ground yarn, and subsequently interknitting a second needle loop of the pile yarn with another needle loop of a ground yarn on a third needle of the needle bar while releasing the held extent of the pile yarn from the second needle without stitch formation to form an underlap loop of the pile yarn extending outwardly from the technical back of the fabric between the first and second needle loops of the pile yarn.

In the preferred embodiment of the present method, a first set of ground yarns are warp knitted in a 1-0, 4-5 stitch pattern, a second set of ground yarns are warp knitted in a 0-1, 1-0 chain stitch pattern, and the pile loop-forming yarns are warp knitted in a 1-2, 0-1, 4-3, 5-4 stitch pattern.

BRIEF DESCRIPTION OF THE DRAWINGS

The drawing FIGURE is a diagram showing individually the stitch pattern for the ground and pile loop-forming yarns carried out by a warp knitting machine in knitting one preferred embodiment of the present fabric according to the method of the present invention.

DESCRIPTION OF THE PREFERRED EMBODIMENT

Figure 1:
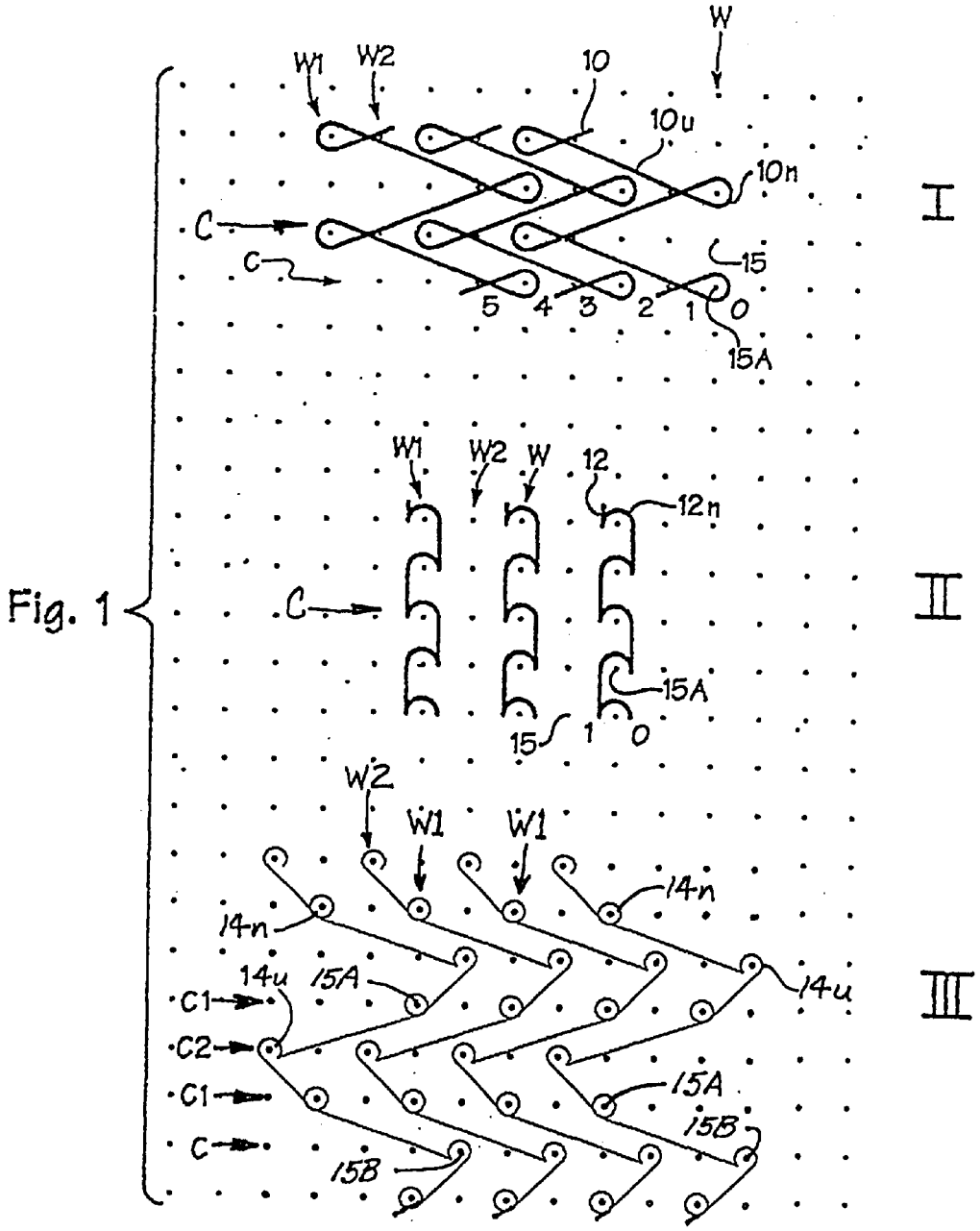

As explained more fully herein, the preferred embodiment of the fabric of the present invention is produced, and the method of the present invention is carried out, on a warp knitting machine which may be of any conventional type of an at least three-bar construction having three or more yarn guide bars and a needle bar, e.g., a conventional tricot warp knitting machine. The construction and operation of such machines are well known in the warp knitting art and need not herein be specifically described and illustrated. In the following description, the yarn guide bars of the knitting machine are identified as "top," "middle" and "bottom" guide bars for references purposes only and not by way of limitation. As those persons skilled in the art will understand, such terms equally identify knitting machines whose guide bars may be referred to as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

Referring now to the accompanying drawing, one particular embodiment of the present textile fabric is illustrated as preferably warp knitted of a three-bar construction on a three-bar warp knitting machine according to the present method. As is conventional, the needle bar of the warp knitting machine carries a series of aligned knitting needles, while each guide bar of the machine carries a series of guide eyes, the needle and guide bars preferably having the same gauge, i.e., the same number of needles and guide eyes per inch. According to the illustrated embodiment of the present fabric, the bottom guide bar of the machine is threaded on alternating guide members with a first set of ground yarns 10 delivered from a warp beam (not shown), the middle guide bar is threaded on alternating guide members with a second set of ground yarns 12 delivered from another warp beam (also not shown), and the top guide bar is similarly threaded on alternating guide members with a set of pile loop-forming yarns 14 supplied from a third warp beam (also not shown). As more fully explained hereinafter, the threading arrangement of the three guide bars is set up in conjunction with the stitch patterns of the three sets of yarn to deliver the ground and pile loop-forming yarns 10, 12, 14 to every alternate needle of the needle bar during the formation of alternate fabric courses and, then, to deliver the ground yarns 10, 12 to every alternate needle of the needle bar while delivering the pile loop-forming yarns 14 to every intervening needle during the formation of intervening fabric courses. For this purpose, the bottom yarn guide bar has every alternate guide eye threaded with a ground yarn 10 and every intervening guide eye empty, commonly referred to as a "one in, one out" threading arrangement, while the middle and top yarn guide bars have every intervening guide eye threaded with a respective ground yarn 12 or pile loop-forming yarn 14 and every alternate guide eye empty, i.e., a "one out, one in" threading arrangement.

It is contemplated that a variety of yarns may be suitable for use as the ground and pile loop-forming yarns. For example, the ground yarns 10, 12 may be inelastic so as to contribute, in conjunction with the fabric stitch construction itself, to the dimensional stability of the fabric. Any of a variety of conventional multifilament synthetic yarns, particularly polyester and nylon yarns, would be suitable for use as the ground yarns. The denier of the ground yarns may vary depending upon the desired weight of the fabric per unit fabric dimension (ounces per square yard). By way of example, ground yarns varying in denier from 40 to 95 could be utilized, although it is also contemplated that lesser or greater denier yarns could also be utilized in appropriate circumstances. Likewise, a variety of possible yarn types may be utilized as the pile loop-forming yarns. In many contemplated embodiments, the pile loop-forming yarns will also preferably be synthetic multifilament yarns, e.g., polyester or nylon, the denier of which will be selected commensurate with the intended end use of the fastener fabric.

In the accompanying FIG. 1, the stitch constructions of the ground and pile loop-forming yarns 10, 12, 14, as carried out by the respective lateral traversing movements of the guide bars of the knitting machine according to one possible embodiment of the present fabric and method, are illustrated individually in a traditional dot or point diagram format, wherein the individual points 15 represent the needles of the needle bar of the knitting machine in the formation of several successive fabric courses C across several successive fabric wales W. According to this embodiment, the bottom guide bar of the warp knitting machine manipulates the first set of ground yarns 10 as they are fed from their respective warp beam to traverse laterally back and forth relative to the needle bar of the machine to stitch the ground yarns 10 on alternate needles 15A in a repeating 1-0, 4-5 stitch pattern, as indicated at I of FIG. 1. Simultaneously, the middle guide bar of the knitting machine manipulates the second set of ground yarns 12 as they are fed from their respective warp beam to traverse relative to the needle bar to stitch the ground yarns 12 on the same alternating needles 15A in a repeating 0-1, 1-0 chain stitch pattern, as indicated at II in FIG. 1. The top guide bar simultaneously manipulates the set of pile loop-forming yarns 14 as they are fed from their respective warp beam to traverse relative to the needle bar alternately to stitch the pile loop-forming yarns 14 on the same alternating needles 15A and then to lay the yarns 14 without stitch formation about spaced intervening needles 15B in a repeating 1-2, 0-1, 4-3, 5-4 stitch pattern, as indicated at III of FIG. 1. As those persons skilled in the art will recognize and understand, the respective simultaneous stitch patterns of the ground and pile loop-forming yarns 10, 12, 14 result in a composite fabric wherein the constituent yarns are integrated with one another.

As will thus be understood, the ground and pile loop-forming yarns 10, 12, 14 are interknitted with one another by formation of respective needle loops 10*n*, 12*n*, 14*n* of the yarns in alternating wales W1 of the resultant fabric, without any needle loops of any of the yarns being formed in the intervening wales W2. More specifically, the stitch construction of the ground yarns 10 forms needle loops 10*n* thereof in alternating wales W1 of every course C, each ground yarn 10 having its needle loops 10*n* alternating every course C across five wales between two wales W1 spaced apart by an intermediate wale W1 and two intervening wales W2 across which elongated underlaps 10*u* of the ground yarn 10 extend diagonally between the successive needle loops 10*n* in a substantially coursewise direction. The ground yarns 12 are formed only in the alternating wales W1, each ground yarn 12 being formed in one respective wale W1 in needle loops 12*n* aligned walewise with one another in every course C, owing to the chain stitch construction of these yarns 12. The stitch construction of the pile loop-forming yarns 14 form them in needle loops 14*n* appearing only in alternating courses C1 and in the alternating wales W1, each pile loop-forming yarn 14 having its needle loops 14*n* formed in the alternating courses C1 and alternatingly between two adjacent wales W1 with an underlap extent 14*u* extending diagonally between the successive needle loops 14*n* generally in the intervening courses C2.

As those persons skilled in the art will recognize, the stitch pattern followed by the pile loop-forming yarns 14 causes each such yarn to be traversed during the formation of each intervening course C2 across a three-needle spacing moving first by a one-needle spacing to and about an adjacent needle 15B in one coursewise direction from the needle 15A on which was formed a needle loop 14*n* in the formation of the preceding course C1 and then in the opposite coursewise direction past such needle 15A to the next adjacent needle 15A, thereby to cause the yarn 14 to extend in a non-knitting manner about the adjacent needle 15B. Such needles 15B hold the pile loop-forming yarns 14 during the formation of the intervening courses C2 and then subsequently shed the yarns 14 without formation of needle loops thereof upon formation of the next succeeding alternate course C1 and, since such needles are not involved in the formation of needle loops of either of the ground yarns 10, 12 during the formation of the courses C2, the held extents of the pile loop-forming yarns 14 do not become anchored in the fabric. As a result, the underlap extents 14*u* of the pile loop-forming yarns 14 are substantially elongated and are free to extend outwardly from the corresponding face of the fabric, i.e. the technical back thereof.

In this fashion, the ground yarns 10, 12 form a base or ground fabric structure which provides substantial dimensional stability to the fabric, the walewise chain stitch construction of the ground yarns 12 restricting the walewise stretchability of the fabric while the construction of the ground yarns 10 with extended coursewise underlaps 10*u* similarly restricting the coursewise stretchability of the fabric. The formation of the pile loop-forming yarns 14 on the top guide bar of the knitting machine form such yarns predominantly at the technical back of the fabric whereat the extended underlaps 14*u* extend generally outwardly of the fabric surface in the nature of elongated terry pile loops. As a result, the underlap loops 14*u* produced by the present fabric construction make the fabric well suited for use as the loop component of a hook-and-loop fastener, the outwardly extending disposition of the underlap loops 14*u* orienting them in zig-zag like back-and-forth diagonal directions for optimal engagement with the hook elements of a mating fastener hook component, which could be of a variety of conventional constructions. Advantageously, the elongated nature of the underlap loops 14*u* provides sufficient loop elevation from the fabric surface that napping, brushing or other mechanical raising of the loops, which is conventionally necessary in other fastener loop fabric constructions, can be avoided altogether.

As may thus be understood, the orientation of the pile loops diagonally with respect to the walewise and coursewise extents of the fabric provides several advantages over the known loop component fabrics described above. Most fundamentally, the diagonal pile loops, and particularly the alternatingly opposing diagonal orientation of the loops, enhances the exposure of the loops to engagement by the hook-shaped elements of a mating hook component and improves the strength of their interengagement. Thus, the so-called peel strength of the current fabric as compared to an otherwise similar fabric having walewise pile loops has been found to be significantly increased by up to three to five times greater peel strength in comparative testing of such similar fabrics.

Further, it will be recognized by those persons skilled in the art that the particular yarns and yarn sizes (denier), as well as the particular stitch patterns followed by the constituent yarns, may be selectively varied, as desired, to modify the properties and characteristics of the resultant fabric to achieve differing embodiments of the fabric suited to differing uses, so long as the stitch construction of the several yarns in selected to achieve elongated underlaps of the pile loop-forming yarns which are not anchored into the fabric structure so as to permit the underlaps to extend outwardly from the resultant fabric in the nature of pile loops. Advantageously, for example, fabrics according to the present invention may be formed of a relatively light weight per square yard such as may be desirable and suitable for adhering or similar lamination to a film or other substrate. In such applications of the present fabric, the diagonal orientation of the pile loops, by providing for a significant portion of the loops to lie over a wale of the underlying ground fabric structure, thereby reduces the possibility of the loops also becoming adhered to the substrate so as to detract from the peel strength of the fabric.

By way of further example, although the preferred embodiment of the present fabric is shown for illustrative purposes as having the pile yarns of Bar III knitted with closed stitches when interknitting with the ground yarns of Bar I and Bar II but formed in open stitches when placed on unoccupied needles to form the pile underlap loops, the pile underlap loops could also be formed as closed stitches (such as by a stitch pattern of 1-2, 1-0, 4-3, 4-5) which will not impede or impair the casting off of the stitches as pile underlaps but would impart a twist to the underlap loops. Likewise, it is contemplated that the fastener loop fabric of the present invention could be of a four bar construction rather than a three bar construction, if desirable to achieve additional or different fabric properties. All such modifications and variations on the present invention are intended to be within the scope of the present invention.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A warp knitted textile fabric having outwardly extending pile underlap loops at one face adapted for mated engagement with hooking elements of a hook component of a hook-and-loop type fastener, the fabric comprising yarns formed in needle loops arranged in longitudinally extending wales and transversely extending courses including at least one set of ground yarns and a set of pile yarns warp knitted in respective cooperating stitch patterns wherein the pile yarns and ground yarns are interknitted in needle loops in only spaced wales and spaced courses with unknitted held extents of the pile yarns extending across the intervening wales and courses diagonally between the spaced wales and spaced courses and outwardly from the technical back of the fabric to form the pile underlap loops of the pile yarns.

2. A warp-knitted textile fabric according to claim 1, wherein the at least one set of ground yarns comprises two sets of ground yarns.

3. A warp knitted textile fabric according to claim 2, wherein the at least one set of ground yarns comprises a first set of ground yarns formed in needle loops in spaced wales of every course and a second set of ground yarns formed in needle loops in a chain stitch pattern in the spaced wales.

4. A warp knitted textile fabric according to claim 3, wherein the first set of ground yarns are warp knitted in a 1-0, 4-5 stitch pattern and the second set of ground yarns are warp knitted in a 0-1, 1-0 chain stitch pattern.

5. A warp knitted textile fabric according to claim 1, wherein each pile yarn is warp knitted in a 1-2, 0-1, 4-3, 5-4 stitch pattern.

6. A warp knitted textile fabric according to claim 3, wherein the underlap loops of the pile yarns extend outwardly from the technical back of the fabric in opposite directions coursewise of the fabric.

7. A warp knitted textile fabric according to claim 5, wherein the underlap loops of the pile yarns extend outwardly from the technical back of the fabric in opposite directions coursewise of the fabric.

8. A method of producing a warp knitted textile fabric having a set of pile underlap loops extending outwardly from the technical back of the fabric for mated engagement with hooking elements of a hook component in a the hook-and-loop type fastener, said method comprising the steps of:

providing a warp knitting machine having a needle bar supporting a series of knitting needles;

simultaneously warp knitting at least one set of ground yarns and a set of pile yarns in cooperating stitch patterns of needle loops on the needle bar to form a warp knitted fabric, wherein:

each pile yarn is warp knitted by sequentially interknitting a first needle loop of the pile yarn with a needle loop of a ground yarn on a selected needle of the needle bar, interveningly holding an extent of the pile yarn in a non-knitting manner on a second needle of the needle bar unoccupied by any ground yarn, and subsequently interknitting a second needle loop of the pile yarn with another needle loop of a ground yarn on a third needle of the needle bar while releasing the held extent of the pile yarn from the second needle without stitch formation to form a pile underlap loop of the pile yarn extending outwardly from the technical back of the fabric between the first and second needle loops of the pile yarn.

9. A method of producing a warp knitted textile fabric according to claim 8 and further comprising warp knitting a first set of the ground yarns in needle loops on spaced needles and a second set of the ground yarns in needle loops in a chain stitch pattern on the spaced needles.

10. A method of producing a warp knitted textile fabric according to claim 8 and further comprising wrap knitting the pile yarns in a 1-2, 0-1, 4-3, 5-4 stitch pattern.

11. A method of producing a warp knitted textile fabric according to claim 8 and further comprising warp knitting a first set of the ground yarns in a 1-0, 4-5 stitch pattern.

12. A method of producing a warp knitted textile fabric according to claim 8 and further comprising warp knitting a second set of the ground yarns in a 1-0, 0-1 chain stitch pattern.

* * * * *